United States Patent [19]

Leto

[11] Patent Number: 4,669,767

[45] Date of Patent: Jun. 2, 1987

[54] TRUCK DOOR LOCKING SYSTEM

[76] Inventor: Paul Leto, 4453-88th, Urbandale, Iowa 50322

[21] Appl. No.: 839,104

[22] Filed: Mar. 13, 1986

[51] Int. Cl.[4] ..... E05C 19/18

[52] U.S. Cl. ..... 292/259 R; 70/94; 70/DIG. 63; 70/DIG. 64; 70/DIG. 65; 211/4; 292/292; 312/216; 312/217

[58] Field of Search ..... 292/259 R, DIG. 38, 292/150, 148, 289, 292; 70/94, 158–162, 423, 425, 427, 428, DIG. 63, DIG. 64, DIG. 65; 49/394, 395, 37, 56, 57; 211/4; 312/216, 217, 219; 296/50, 146; 180/289; 280/152 A

[56] References Cited

U.S. PATENT DOCUMENTS

| | | | |
|---|---|---|---|
| 259,415 | 6/1882 | Morse et al. | 70/160 |
| 691,093 | 1/1902 | Bagley | 70/161 |
| 2,665,161 | 1/1954 | Stehling . | |
| 3,665,736 | 5/1972 | Wilson | 70/78 |
| 3,752,518 | 8/1973 | Cannell | 292/148 X |
| 3,833,104 | 9/1974 | Blum | 312/217 X |
| 3,865,426 | 2/1975 | Barnhart | 296/146 X |
| 4,109,949 | 8/1978 | Smith | 292/150 X |
| 4,113,291 | 9/1978 | Cameron | 70/DIG. 63 X |
| 4,325,203 | 4/1982 | Wicks | 49/57 |
| 4,335,909 | 6/1982 | Schmitz | 70/159 X |
| 4,491,354 | 1/1985 | Williams | 292/259 R X |
| 4,500,123 | 2/1985 | Harms | 292/259 A |

FOREIGN PATENT DOCUMENTS

| | | | |
|---|---|---|---|
| 20241 | 1/1905 | Austria | 292/259 |
| 77734 | 8/1919 | Austria | 292/148 |
| 165153 | 1/1950 | Austria | 292/259 |
| 1054819 | 5/1979 | Canada | 70/427 |

*Primary Examiner*—Gary L. Smith
*Assistant Examiner*—Lloyd A. Gall
*Attorney, Agent, or Firm*—James D. Birkenholz

[57] ABSTRACT

In association with a conventional truck box, trailer or enclosure having a rear door communicating with the sides, top and bottom of the enclosure, a hollow holding sleeve is secured to the inside of the door with a securing plate fastened to one side of the enclosure and a locking plate to the other side. The plates include apertures which are aligned with the hollow holding sleeve and the locking plate communicates with the exterior of the enclosure. A locking bar extends through the aperture of the locking plate and the hollow holding sleeve and into the aperture of the securing plate. A locking device is mounted onto the locking plate to securely hold the locking bar in place. When the locking bar is in place, movement of the door is prohibited and the door can not be opened.

2 Claims, 6 Drawing Figures

TRUCK DOOR LOCKING SYSTEM

BACKGROUND OF INVENTION

1. Field of the Invention.

The present invention relates generally to truck equipment and specifically to a truck door locking system for the securing of a truck enclosure door in a closed position.

2. Designation of the Prior Art.

In the trucking industry, entry doors on the back of truck trailers, boxes and enclosures include means for the holding of the door in a closed position. These typically include a lever situated on the outside of the door with provisions made for the attachment of a padlock or other locking device. Unfortunately such locking means are easily and quickly removed allowing access to the truck enclosure. Typically unauthorized opening of the enclosure occurs when the truck or trailer is parked overnight and left unattended with the trailers parked parallel to each other in a row alignment. Unfortunately with conventional door locking systems, this facilitates unauthorized entry to the units. There are numerous locking devices which provide security to doors, however, they do not prevent unauthorized entry in a secluded area where constant surveillance is not available. Typical of such devices include U.S. Pat. No. 4,491,354 to Williams disclosing a locking bar, U.S. Pat. No. 4,500,123 to Harms disclosing an outside mounted locking bar, U.S. Pat. No. 3,665,736 to Wilson disclosing a universal telescoping locking bar and U.S. Pat. No. 2,665,161 disclosing a securement for hatch covers. This art is not adaptable to truck doors which must under normal circumstances be freely operable and which are not accessible, i.e. locks, bars set from the outside of the trailer. Any locking device which is accessible from the outside is vulnerable and subject to being forcibly removed resulting in free access to the enclosure.

SUMMARY OF THE INVENTION

There is provided a hollow holding sleeve secured to the interior of a door on a truck trailer or box enclosure. A securing plate and locking plate are attached to the interior of the side of the enclosure with the locking plate communicating with the exterior of the enclosure. Each includes apertures extending therethrough with the plates positioned wherein the longitudinal axis of the holding sleeve is in alignment with the apertures. A locking bar extends through the aperture of the locking plate and the holding sleeve to engage the apertures of the securing plate. A locking device attached to the locking plate selectively engages the locking bar to securely hold it in place.

DESCRIPTION OF PREFERRED EMBODIMENT

Figure 2:
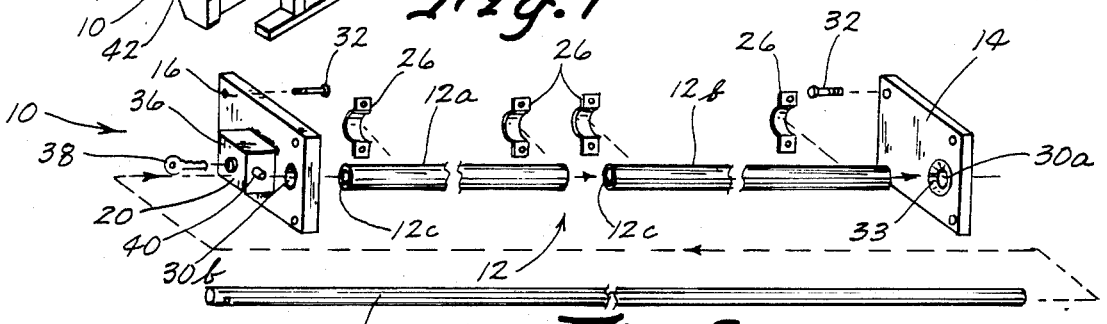
FIG. 2 is an exploded view of the door locking system.

Referring now to the drawings where like reference numerals designate identical or corresponding parts throughout the several views, the truck door locking system is illustrated generally at 10 of FIG. 2.

Generally, the truck door locking system 10 includes a hollow holding sleeve 12, a securing plate 14 and a locking plate 16 with a locking bar 18 extending therethrough and a lock device 20 engaging the bar 18.

Figure 1:
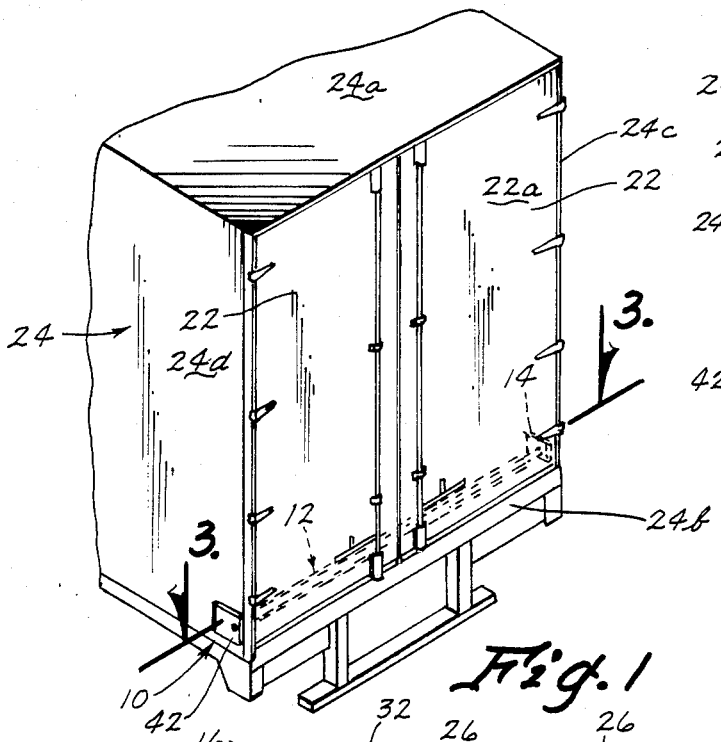
FIG. 1 is a partial perspective view of a conventional truck box or trailer enclosure illustrating the truck door locking system of the present invention on double swinging doors.
Figure 6:
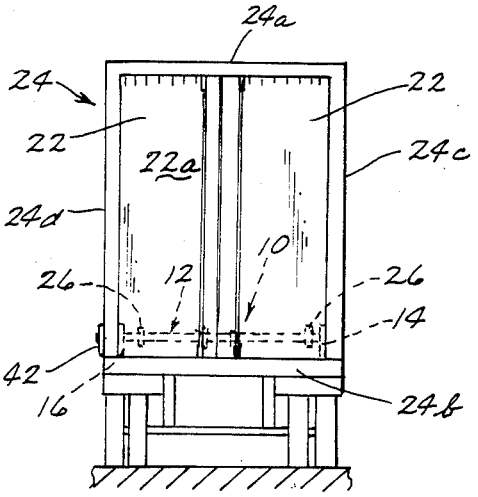
FIG. 6 is an end view of a truck illustrating the truck door locking system on a single rear door.
Figure 3:
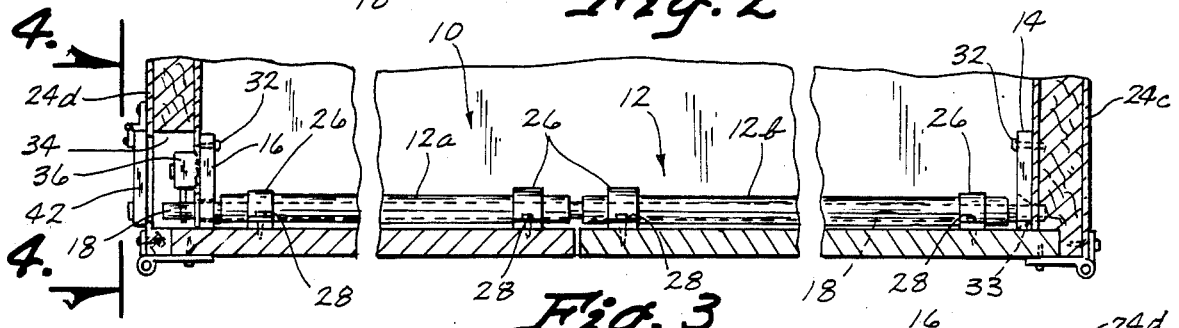
FIG. 3 is a cross-sectional view of the truck door locking system taken along lines 3—3 of FIG. 1.
Figure 4:
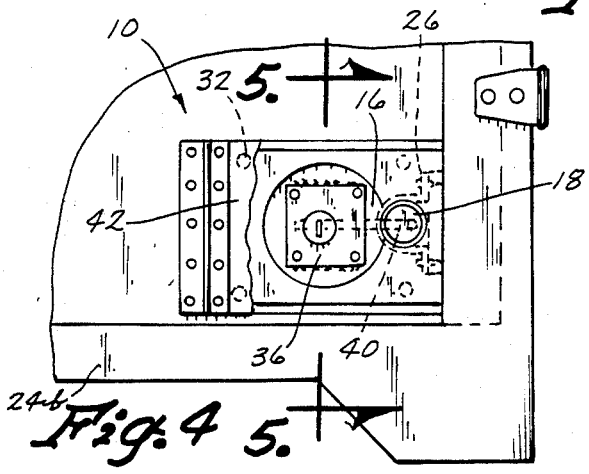
FIG. 4 is a cross-sectional view of the truck door locking system taken along lines 4—4 of FIG. 3.
Figure 5:
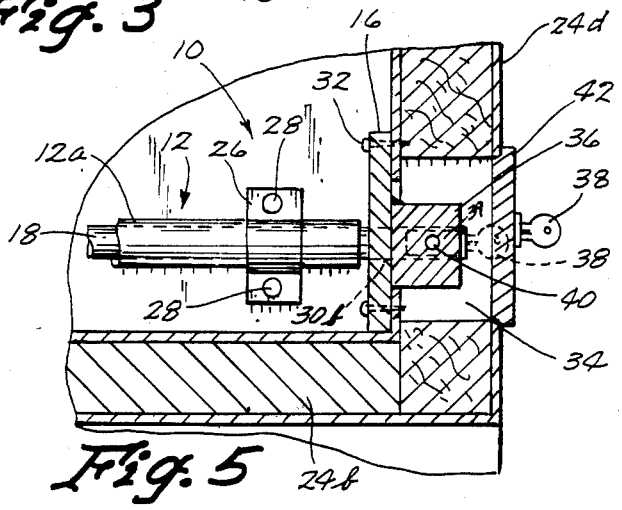
FIG. 5 is a cross-sectional view of the truck door locking system taken along lines 5—5 of FIG. 4.

Specifically, the holding sleeve 12 (FIGS. 1-5) includes a hollow portion **12*c* extending longitudinally through the sleeve 12. The holding steeve 12 is securely mounted onto the inside portion of the doors 22 of a conventional truck box or trailer enclosure 24. The rear doors 22 typically are two outward swinging doors or a single door 22*a* (FIG. 1) which moves on a track up and down between an open/closed position. To simplify further discussion, unless otherwise specifically noted, reference to door 22 shall further include doors of design per FIG. 1 at 22*a*. The door 22 is at the rear of the trailer 24 and communicates with the top 24*a*, bottom 24*b* and sides 24*c* and 24*d* of the trailer enclosure 24. The sleeve 12 extends across the bottom of the door 22 and throughout the width of the interior portion of the door 22 and per FIGS. 1, 2 and 3 includes sections 12*a* and 12*b* with dual swinging doors 22 and a single sleeve 12 with the truck door 22*a* (FIG. 6). Further references to the sleeve 12 shall likewise include the specific sleeve 12 and sleeves 12*a* and 12*b* unless otherwise noted. The sleeve 12 is secured to the inside of the door 22 by brackets 26. The brackets 26 include a portion which conforms to the shape of the sleeve 12 and engages the sleeve 12 to hold it securely against the door 22 and are held to the door 22 by conventional screws 28. The securing and locking plates 14 and 16 respectively are formed from heavy metal plates and each include an aperture 30*a/b* respectively. The plates 14 and 16 are mounted onto the interior portion of the trailer sides 24*c* and by conventional screws 32 passing through the plates 14 and 16 to engage the respective sides 24 *d* and *c*. The plates 14 and 16 are spaced with apertures 30 *a* and *b* in alignment with the holding sleeve 12 and particularly the aperture 12*c*. The locking plate 16 also communicates with the exterior of the side 24*d* through a cut out portion 34 of the side 24*d***.

The locking bar 18 formed from solid metal stock has a cross-sectional area less than the interior cross-sectional area of the hollow holding sleeve 12, particularly that of aperture **12*c* and the apertures 30 *a* and *b* of plates 14 and 16 and has a length sufficient to permit it to be inserted through the locking plate 16, the hollow holding sleeve 12 and into the aperture 30*a* and of the securing plate 14 with a portion extending beyond the aperture 30*b* of the locking plate 16 (FIG. 2-5). The securing plate 14 further includes an alignment surface 33 circumferentially around the aperture 30*a* and being generally a concave region extending from the interior flat surface of the plate 14 to the aperture 30*a*, to assist the passage of the bar 18 into the aperture 30*a*. A locking device 36 is securely mounted onto the locking plate 16 and includes a conventional key 38 operating lock 39 whereby a cam 40 is moved in and out of the locking device 36. The cam 40 upon being rotated out engages the locking bar 18 and prevents its movement. A door on the exterior of the side 24*d* overlaying the section 34** is likewise lockable through conventional means to further restrict access of the locking device 36.

In operation of the truck door locking system 12, the door 22*a* or doors 22 of the box or trailer enclosure 24 of a truck are first closed in their normal manner. This results in the alignment of the holding sleeve 12 or 12*a* and 12*b* with each other where two swinging doors 22 are present, with the aperture 30*a* and 30*b* of the securing plate 14 and locking plate 16. The locking bar 18 is then inserted through the aperture, the hollow sleeve 12 and 12 *a* and *b* and into the aperture 30*a*. A portion of the locking bar 18 extends beyond the locking plate 16 and receives a portion of the cam 40 upon activation of the locking device 36. With the cam 40 inserted into the bar 18, the bar 18 can not be moved and upon engagement of the apertures 30 *a* and *b* and the sleeve 12 the door 22 can not be moved, either outward for doors 22 or upward per door 22*a*.

Other designs of locking devices are possible which will function to hold the locking bar within the given structure including conventional padlock assemblies and the system is readily adjustable to operate with a padlock or other type of lock.

When the truck or trailer enclosures are conventionally parked parallel to each other, generally very close, there typically is not enough room between the enclosure to permit access to and removal of the locking bar. Removal of the locking bar from the outside of the door 22 is not possible so access to the bar is only via the side without complete destruction of the door, thus a locking system is provided for truck doors which provides security while the trailer or truck is parked and left unattended.

It is understood the specific dimension of the various components and parts may be changed but still fall within the intended scope of the invention. Obviously many modifications may be made to applicant's invention in light of the above teachings. It is therefore to be understood that the invention may be practiced other than as specifically set forth above and still come within the scope of the appended claims.

I claim:

1. In a truck door locking system for the securing of a truck trailer or truck box enclosure door in a closed position, the door located at the rear of the trailer in a closed position and communicating with the sides, top and bottom of the trailer and movable between an open and closed position, the improvement comprising:

an elongated hollow holding sleeve secured to the inside of the door and extending lengthwise across the width of the door;

a locking plate and securing plate, the securing plate secured to one side of the trailer and the locking plate secured to the opposite side of the trailer, each plate including an aperture with said apertures being aligned with the sleeve with the aperture of the locking plate further communicating with the exterior of the trailer side through a cut out portion therein;

a locking bar, the bar having a cross-sectional area throughout its length which is less than the cross-sectional area of the holding sleeve and the apertures of the locking and securing plates and a portion thereof generally being inserted through the aperture of the locking plate, hollow holding sleeve and the aperture of the securing plate thereby preventing movement of the hollow holding sleeve when the locking bar is extending therethrough;

a locking means, said locking means attached to the locking plate for selectively securing the locking bar within the locking plate;

brackets, the brackets partially conforming to the shape of the hollow holding sleeve and secured to the inside of the trailer door with the hollow holding sleeve passing between the brackets and door and held securely against the door;

an alignment surface, the alignment surface circumferentially spaced about the aperture on the securing plate for permitting the locking bar to align with the aperture therein.

2. In a truck door locking system for the securing of a truck door in a closed position, the truck door including a pair of doors in a closed position and communicating with the sides, top and bottom of an enclosure and being generally movable between an open and closed position, the improvement comprising:

an elongated hollow holding sleeve secured to the inside of each door and extending lengthwise across the width of each door and in the same longitudinal axis;

a locking plate and securing plate, the securing plate secured to one side of the enclosure and the locking plate secured to the opposite side of the enclosure, each plate including an aperture with the apertures being aligned with the adjacent holding sleeve and the aperture of the locking plate further communicating with the exterior of the enclosure side through a cut out portion therein;

a locking bar, the bar having a cross-sectional area throughout its length which is less than the cross-sectional area of the holding sleeve and the aperture of the locking and securing plates and a portion thereof generally being inserted through the aperture of the locking plate, holding sleeves and the aperture of the securing plate thereby preventing movement of the holding sleeves when the locking bar is extending therethrough;

a locking means, said locking means attached to the locking plate for selectively securing the locking bar within the locking plate;

brackets, the brackets partially conforming to the shape of the hollow holding sleeve and secured to the inside of the trailer door with the hollow holding sleeve passing between the brackets and door and held securely against the door;

an alignment surface, the alignment surface circumferentially spaced about the aperture on the securing plate for permitting the locking bar to align with the aperture therein.

* * * * *